US006354924B1

(12) United States Patent
Trafton et al.

(10) Patent No.: US 6,354,924 B1
(45) Date of Patent: Mar. 12, 2002

(54) PARTICULATE MATTER DELIVERY DEVICE COMMERCIAL UNIT

(76) Inventors: John E. Trafton; Henry B. Schur, both of 376 Ansin Blvd., Hallandale, FL (US) 33009

( * ) Notice: Subject to any disclaimer, the term of this patent is extended or adjusted under 35 U.S.C. 154(b) by 0 days.

(21) Appl. No.: 09/360,793

(22) Filed: Jul. 26, 1999

(51) Int. Cl.[7] ..... B24C 7/00; B24C 5/02
(52) U.S. Cl. ..... 451/90; 451/101
(58) Field of Search ..... 451/102, 90, 38, 451/99, 39, 101

(56) References Cited

U.S. PATENT DOCUMENTS

| | | | | | |
|---|---|---|---|---|---|
| 3,631,631 | A | * | 1/1972 | Greenstein | 451/75 |
| 4,475,370 | A | * | 10/1984 | Stark et al. | 451/89 |
| 5,160,547 | A | * | 11/1992 | Kirschner et al. | 134/7 |
| 5,330,354 | A | * | 7/1994 | Gallant | 433/88 |
| 5,839,946 | A | * | 11/1998 | Hertz | 451/90 |

* cited by examiner

*Primary Examiner*—Robert A. Rose
(74) *Attorney, Agent, or Firm*—Robert Van Der Wall

(57) ABSTRACT

The present invention includes an apparatus for delivery of pressurized particulate matter against a surface or target to abrade, texture, sandblast, etch, erase, cut, penetrate, smooth, clean, polish, harden and/or deburr the surface or target. The invention is expected to be used largely by hobbyists, although numerous other uses are within the contemplation of the inventors. Included is a fluidizing chamber having a discharge end of an inlet tube that is disposed below or overlaps the intake end of the cannula such that the discharge of the inlet tube blows the particulate matter into the fluid above the intake end of the cannula, thereby suspending it therein, without clogging. The invention further provides for dual check valve function in several different embodiments to prevent backflow of particulate matter in the event of a drop in pneumatic pressure, and also to prevent excessive pressure from reaching the fluidizing chamber and cannula in the event of a pressure surge. The barrel end cap includes a refill aperture, which is threaded to accept a removable refill aperture plug. With the plug removed, the fluidizing chamber can be recharged with particulate matter using a filling cartridge. This structure allows for the invention to be recharged with particulate matter. In order to accomplish this, it is also necessary to disconnect the top end of the tapered barrel in the form of a locking hub end from a hub end connector that is downstream of the pressure source.

9 Claims, 2 Drawing Sheets

PARTICULATE MATTER DELIVERY DEVICE COMMERCIAL UNIT

BACKGROUND OF THE INVENTION

FIELD OF THE INVENTION

This invention relates to delivery devices, and in particular to a commercial unit of an apparatus for delivery of pressurized particulate matter against a surface or target to abrade, texture, sandblast, etch, erase, cut, penetrate, smooth, clean, polish, harden and/or deburr the surface or target. The invention is expected to be used largely by hobbyists, although numerous other uses are within the contemplation of the inventors.

BACKGROUND OF THE INVENTION

The present invention is a refillable fluidizing chamber, cannula and check valve assembly intended for use primarily by hobbyists. It differs significantly in use from the predecessor invention disclosed and claimed in the immediately prior parent application. The latter was a device intended for use by dentists and dental hygienists, and was approved for that use by the FDA. The parent application also differs because it was prefilled, sealed, and disposable to avoid contamination so it would qualify for FDA approval. No such requirements exist for the present invention.

Earlier designs of pressurized particulate matter delivery devices have demonstrated there can be difficulty with clogging in the fluidizing chamber and/or the delivery tube. The present invention is partially directed to an improved internal structure of the fluidizing chamber which produces effective fluidization without clogging.

The invention further provides for a double function check valve feature, that may either of at least three possible configurations. Regardless of which configuration is employed, the first function is to prevent backflow of particulate matter in the event of a drop in pneumatic pressure. The second function is to prevent excessive pressure from reaching the fluidizing chamber and delivery tube in the event of a pressure surge.

The preferred configuration is to employ a duckbill valve in the fluidizing chamber at the end of the inlet tube to prevent backflow in the event of a pressure drop in combination with a single acting flapper valve prior to the fluidizing chamber as a pressure limiting device. The first alternative embodiment is to use a resiliently biased double acting flapper member type check valve in series with the fluidizing chamber to both to close off the pressure source connection to prevent backflow if the pressure drops to a threshold value and also to resist excessive pressure from a pressure source. A second alternative embodiment of the dual function check valve feature is the custom designed double acting mechanical (coil spring biasing) check valve of the immediate predecessor parent invention, which is fully disclosed again herein.

The double function check valve feature, regardless of which configuration is used, is designed to be in fluid communication with a pneumatic pressure line that is operated on and off by a control apparatus that may optionally be in the form of a foot pedal. Since this control apparatus technology is well known, it is not disclosed and is referred to as conventional.

Another feature of the invention includes a disposable cannula that preferably includes a tapered nozzle (which may be really a disposable hypodermic needle) which can be detached from the refillable fluidizing chamber. Detachment is important because the cannula will need to be replaced regularly, since the grit is abrasive and wears out the cannula more quickly than other components in the inventive assembly. Detachment also facilitates optional availability of a plurality of differing tips to accommodate differing grit sizes and different pressure in the fluidizing chamber. Also available are bent particle delivery cannula, which are furnished bent at a 45 degree angle or a 90 degree angle.

Examples of prior known devices include that described in U.S. Pat. No. 4,941,298 to Fernwood, which discloses a rear-reservoir micro sandblaster. The Fernwood patent has numerous problems including costly to dispose, special training for set up and use, and cannot deliver varying sizes of particles. Other known devices with similar problems are the Microetcher™ and the Handiblaster™ available from Mirage/Chameleon Dental Products, Inc.

SUMMARY OF THE INVENTION

The primary object of the present invention is to provide a pressurized particulate matter delivery device intended to be used largely by hobbyists that includes a refillable fluidizing chamber, cannula and dual check valve functions. The inventive device provides delivery of pressurized particulate matter against a surface or target to abrade, texture, sandblast, etch, erase, cut, penetrate, smooth, clean, polish, harden and/or deburr the surface or target.

Another important object of the present invention is to provide a particulate matter delivery device that includes an improved internal structure of the fluidizing chamber which produces effective fluidization without clogging.

One more important object of the present invention is to provide a particulate matter delivery device wherein the fluidizing chamber and cannula assembly is in series with a double function check valve feature, the first of which is to prevent excessive pressure from reaching the fluidizing chamber and delivery tube in the event of a pressure surge, and the second is to prevent backflow of particulate matter in the event of a drop in pneumatic pressure.

A related object of the invention is to satisfy the foregoing objective by employing a single acting resiliently biased flapper check valve in series with the fluidizing chamber and a separate duckbill valve in the fluidizing chamber to both resist excessive pressure from a pressure source and prevent backflow in the event of a pressure drop below a threshold value.

A further related object of the invention is to satisfy the foregoing objective by employing a double acting resiliently biased flapper member type check valve in series with the fluidizing chamber to both resist excessive pressure from a pressure source and prevent backflow in the event of a pressure drop below a threshold value.

An alternative related object of the invention is to satisfy the same objective by employing a custom designed double acting safety mechanical check valve.

Another object of the invention includes a disposable cannula, preferably with a tapered nozzle. The cannula can be detached from the refillable fluidizing chamber, in part because the cannula will need to be replaced regularly, since the grit is abrasive and wears out the cannula more quickly than other components in the inventive assembly.

A further related object of the invention is facilitate interchangeable availability and use of a plurality of different cannula tips to accommodate differing grit sizes and different pressure in the fluidizing chamber and to allow use of various bent particle delivery cannula, which are furnished straight, bent at a 45 degree angle or bent at a 90 degree angle.

A further object of this invention is to provide a device for delivery of a fluid particle stream using a cannula with a tapered nozzle to accelerate particle velocity.

An additional object of this invention is to provide a particulate matter delivery apparatus that is lightweight to facilitate convenient use by a hobbyist or other user.

Further objects and advantages of this invention will be apparent from the following detailed description of a presently preferred embodiment which is illustrated schematically in the accompanying drawings.

In accordance with a major aspect of the invention, there is provided an apparatus for delivery of pressurized particulate matter against a surface or target to abrade, texture, sandblast, etch, erase, cut, penetrate, smooth, clean, polish, harden and/or deburr the surface or target. A preferred embodiment thereof includes a refillable fluidizing chamber for mixing fluid and particulate matter together by suspending the latter in the former, and a detachable cannula tube having a particle accelerating tapered nozzle extending outside the fluidizing chamber, wherein the cannula tube delivers pressurized particulate matter from the fluidizing chamber to a surface or target at a high velocity.

The fluidizing chamber incorporates a simple yet extremely effective internal structure to accomplish the suspension of the particulate matter in the fluid, usually air. It is merely comprised of a discharge end of an inlet tube that is disposed below the intake end of the cannula or overlaps it. The effect is that the discharge of the inlet tube blows the particulate matter into the fluid above the intake end of the cannula, thereby suspending it therein, without clogging.

The components of the fluidizing chamber structure are comprised of a tapered barrel, to which the cannula is detachably connected, and a barrel end cap, to which the inlet tube is fixedly inserted. The barrel end cap preferably has external threads which rotate about and engage mateable internal threads inside the top of the barrel of the fluidizing chamber. The barrel end cap includes a refill aperture, which is threaded to accept a removable refill aperture plug. With the plug removed, the fluidizing chamber can be recharged with particulate matter using a filling cartridge, which is preferably equipped with a snap tip and a fill nozzle. This structure allows for the invention to be recharged with particulate matter. In order to accomplish this, it is also necessary to disconnect the top end of the tapered barrel in the form of a locking hub end from a hub end connector that is downstream of the pressure source.

Another important aspect of the preferred embodiment is the double function check valve feature. The first is to prevent backflow of particulate matter in the event of a drop in pneumatic pressure, and the second is to prevent excessive pressure from reaching the fluidizing chamber in the event of pressure surge, such as from a runaway unregulated compressor.

The preferred configuration is to employ a duckbill valve in the fluidizing chamber at the end of the inlet tube to prevent backflow in the event of a pressure drop in combination with a single acting flapper valve prior to the fluidizing chamber as a pressure limiting device. The first alternative embodiment is to use a resiliently biased double acting flapper member type check valve in series with the fluidizing chamber to both to close off the pressure source connection to prevent backflow if the pressure drops to a threshold value and also to resist excessive pressure from a pressure source. A second alternative embodiment of the dual function check valve feature is a custom designed double acting mechanical (coil spring biasing) check valve. The first function is to seal off the pressure source when the pressure drops to a threshold level to prevent backflow of particulate matter into the pressure line.

In the preferred embodiment, the duckbill valve accomplishes this, and the single acting flapper valve is biased into a neutral position so that high pressure will be necessary to close off the fluidizing chamber. In the first alternative embodiment, resilient biasing is used to hold the double acting flapper member in blocking relationship to the exit orifice of the pressure line, since a pressure drop will then permit this blocking function to occur. Put another way it accomplishes this by simply holding the flapper valve against the exit orifice of the pressure line when there is insufficient pressure to resist the biasing force. The second function, preventing excessive pressure from reaching the fluidizing chamber and ultimately the particle stream exiting the cannula is accomplished by the pressure rising to the level that the double acting flapper member is pushed into a blocking relationship with the inlet tube of the fluidizing chamber.

The second alternative embodiment is the custom designed double acting mechanical safety check valve of the immediate predecessor parent invention. It is also disposed between the fluidizing chamber and a pneumatic pressure line. This check valve similarly acts to prevent particulate matter from being drawn back in to the pneumatic pressure line in the event of a sudden drop in pressure, but will also will seal off the inlet tube into the fluidizing chamber in the event of a pressure surge such as may occur with a regulator failure or an unregulated runaway compressor.

Another feature of the invention includes a disposable and replaceable cannula which preferably includes tapered nozzle to accelerate the particulate matter as it exits from the cannula. The cannula may be conventional (really a disposable hypodermic needle). Regardless of its design detail, it must be detachable from the refillable fluidizing chamber. Detachment is important because the cannula will need to be replaced regularly, since the grit is abrasive and wears out the cannula more quickly than other components in the inventive assembly. Detachment also facilitates optional availability of a plurality of differing tips to accommodate differing grit sizes and different pressure in the fluidizing chamber. Also available are bent particle delivery cannula, which are furnished bent at a 45 degree angle or a 90 degree angle. The tapered aspect of the cannula acts as a particle accelerator because it increases the velocity of the particles exiting from the cannula discharge orifice.

The invention is designed to attach to a pneumatic pressure line and is operated on and off by a control apparatus that may optionally be in the form of a foot pedal. The fluidizing chamber and cannula assembly is lightweight and removably connected to the pressure source.

DESCRIPTION OF THE PREFERRED EMBODIMENTS

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
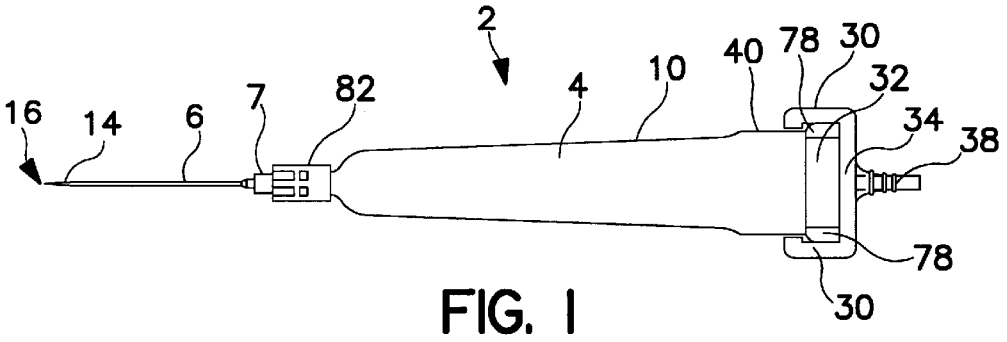
FIG. 1 is a plan view of the particulate matter delivery device commercial unit.

FIG. 1 is a plan view of the particulate matter delivery device commercial unit 2, having a fluidizing chamber 4 and detachable cannula 6. The fluidizing chamber 4 includes a tapered barrel 10 which has an enlarged barrel top end 40. The barrel top end 40 terminates in a locking hub end 32 removably interlocking hub end connector 34 which terminates with pneumatic pressure line connector 38. Interlocking occurs as more fully explained hereinafter by the locking relationship between hub end connector jaws 30 and locking hub end bulges 78. Cannula 6 preferably includes a tapered nozzle 14 to accelerate particle velocity toward a target (not shown). Cannula 6 terminates, of course, with a discharge orifice 16.

Figure 2:
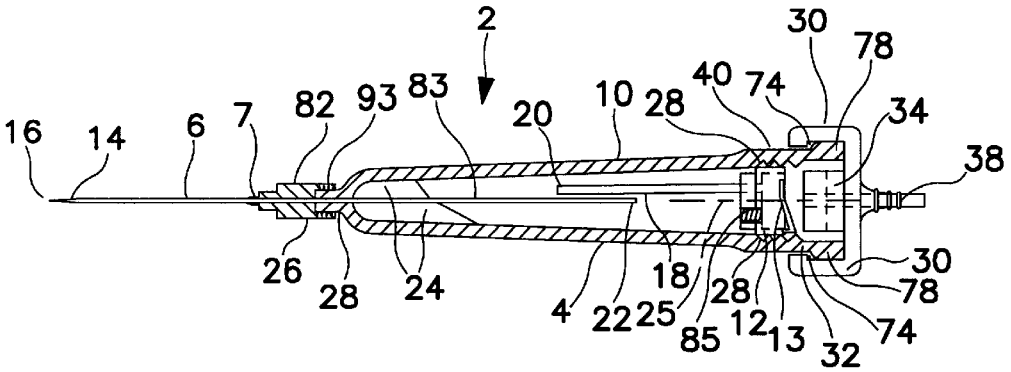
FIG. 2 is a partial cross-sectional view of the particulate matter delivery device commercial unit of FIG. 1, showing the interior structure of the fluidizing chamber, and barrel end cap with a flapper check valve member in the operating neutral position, and refill aperture.
Figure 2A:
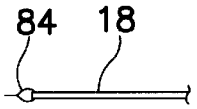
FIG. 2A is a fragmentary broken view of the inlet tube to show its preferred termination with a duckbill valve.

FIG. 2 is a partial cross-sectional view of the particulate matter delivery device 2 of FIG. 1, showing the interior structure of the fluidizing chamber 4. Inlet tube 18 having discharge end 20 is shown overlapping the intake end 22 of outlet tube 83 to achieve the suspension of particulate matter in fluid such as air. Since the particulate matter delivery device commercial unit 2, when in use, is usually held substantially erect with the cannula 6 generally below the fluidizing chamber 4, the particulate matter 24 will generally then be resting at the cannula end of the tapered barrel 10. It is for that reason that the above description refers to the internal structure of the fluidizing chamber 4 as having a discharge end 20 of inlet tube 18 that is disposed "below" the intake end 22 of the outlet tube 83.

Locking hub end 32 of enlarged barrel top end 40 and hub end connector 34 interconnect, using locking hub end bulges 78 and the hub end connector jaw lips 74 of the hub end connector jaws 30. Cannula 6 may actually be a conventional disposable hypodermic needle having luer locking hub 7. Cannula 6 is removably attached to a conventional luer locking male adapter 82, which in turn is attached to threaded discharge end 93 of tapered barrel 10. Discharge tube 83 is held in barrel aperture 28 concentric with both threaded discharge end 93 and centerline 25 of tapered barrel 10. Elsewhere, barrel end cap 12 is shown attached to tapered barrel 10 at mateable threads 28. Also seen are check valve flapper member 13, refill aperture 85, pneumatic pressure line connector 38, and hub end connector jaws 30. Hub end connector jaws 30 interconnect with locking hub end 32 using locking hub end bulges 78 on locking hub end 32 at the enlarged barrel top end 40 of tapered barrel 10.

Figure 3:
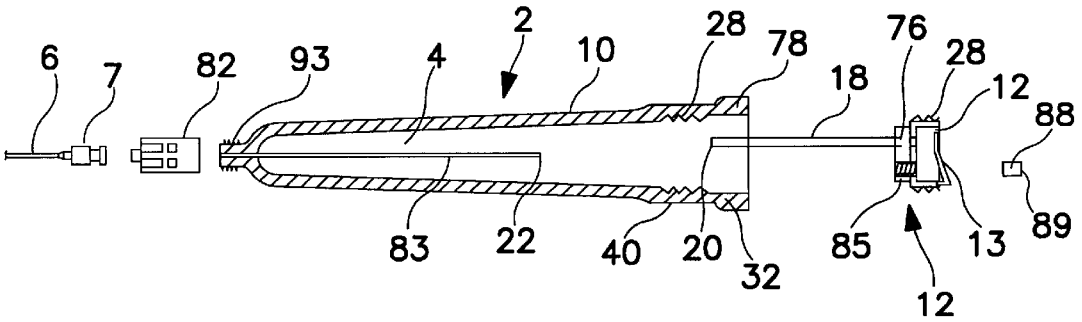
FIG. 3 is an exploded cross sectional view of the particulate matter delivery device commercial unit with the hub end connector removed showing, in part, a cross section of the barrel end cap with inlet tube attached partially removed from the barrel and with the refill aperture plug removed from the barrel end cap.

FIG. 3 is an exploded cross sectional view of the particulate matter delivery device commercial unit 2 with the hub end connector removed showing, in part, a cross section of the barrel end cap 12 with inlet tube 18 attached partially removed from the tapered barrel 10 and with the filling aperture plug 88 removed from the barrel end cap 12. The filling aperture plug 88 includes an allen wrench hex recess 89 to facilitate its removal from and replacement into barrel end cap 12 for recharging of particulate matter 24 (seen in FIG. 2) into the fluidizing chamber 4. Also seen are inlet tube intake 76, threaded discharge end 93 of tapered barrel 10, and in its neutral operating position, check valve flapper member 13, which can be employed either in a single acting or double acting posture. Biasing direction will depend on whether it is required to protect against backflow of particulate matter, in the absence of the duckbill valve at the end of the inlet tube in the fluidizing chamber. Much more readily visible than in the prior figure are mateable threads 28 both inside enlarged barrel top end 40 and outside barrel end cap 12.

Figure 4:
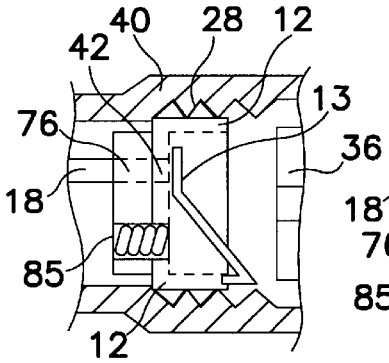
FIG. 4 is an enlarged fragmentary cross-sectional view of the barrel with the barrel end cap in threaded engagement with the barrel and showing the flapper check valve member positioned in blocking relationship with the inlet tube to prevent excessive pressure from reaching the fluidizing chamber.

FIG. 4 is an enlarged fragmentary cross-sectional view of a portion of the enlarged barrel top end 40 with the barrel end cap 12 in threaded engagement using mateable threads 28. In the preferred embodiment of the invention, the barrel end cap 12 is equipped with a single acting flapper valve. However, in this figure flapper member 13 is shown so that it can be also used in the first alternative preferred embodiment as a double acting flapper member valve. Flapper member 13 acts in cooperation with adjacent structure to achieve either a single acting or double acting check valve function, depending on whether a duckbill valve is employed at the end of the inlet tube. In either the preferred embodiment or the first alternative embodiment, the flapper valve acts to prevent excessive pressure from reaching the fluidizing chamber.

If the first alternative embodiment is considered, the flapper member must serve two functions. In such event, the flapper member firstly blocks backflow of particulate matter into the pneumatic pressure source (not shown) when the pneumatic pressure drops below a threshold value. Secondly, it prevents excessive pressure from reaching the fluidizing chamber and downstream thereof. FIG. 4 is primarily intended to show the use of the flapper member 13 positioned in blocking relationship with the inlet tube intake 76 at barrel end cap aperture 42 to prevent excessive pressure from reaching the fluidizing chamber 4 through inlet tube 18. Of course, it must serve this function regardless of whether the preferred embodiment or first alternative embodiment is in use.

Figure 5:
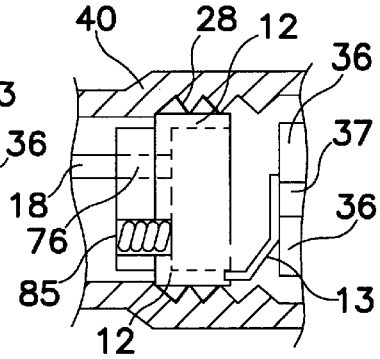
FIG. 5 is another enlarged fragmentary cross-sectional view of the barrel with the barrel end cap in threaded engagement with the barrel and showing the double acting flapper check valve first alternative embodiment with the flapper element positioned to prevent backflow of particulate matter to the pressure source because the resilient biasing of the flapper valve is not overcome by at least the threshold pressure necessary to maintain it in a neutral position as shown in FIGS. 2 and 3. This first alternative embodiment does not employ the duckbill valve on the exit of the inlet tube in the fluidizing chamber, and therefore requires both check valve functions to be accomplished with the double acting flapper member, biased to close off the exit orifice of the pressure source.

FIG. 5 is another enlarged fragmentary cross-sectional view that is a companion of FIG. 4 and is intended to show only the other of the functions when the flapper must serve in a double acting check valve capacity (no duckbill valve on the inlet tube). This other function of the flapper member then blocks backflow of particulate matter into the pneumatic pressure source (not shown) when the pneumatic pressure drops below a threshold value, and occurs because the then double acting flapper member 13 is resiliently biased to the position shown in FIG. 5. That position is in blocking relationship with the hub end connector orifice 37 of the hub end connector body 36, i.e., the double acting flapper member 13 is positioned to prevent backflow of particulate matter to the pressure source because the resilient biasing of the flapper valve is not overcome by at least the threshold pressure necessary to maintain it in a neutral position as shown in FIGS. 2 and 3. Other parts shown in FIG. 5 are as shown in FIG. 4.

Figure 6:
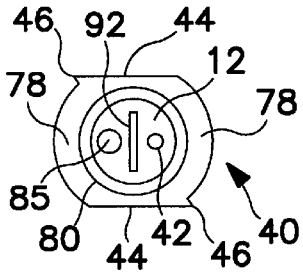
FIG. 6 is an end view of the barrel end cap showing both the eccentric position of the opening into which the inlet tube is placed to accommodate the fact that the discharge end of an inlet tube is disposed below the intake end of the cannula, which is concentric with the barrel. This figure also shows the alternating barrel end cap flats and bulges of the locking hub end, the refill aperture with the refill plug removed, and a screwdriver slot to assemble and disassemble the tapered barrel and barrel end cap.

FIG. 6 is a end view of the enlarged barrel top end 40 with the hub end connector 34 and the flapper member 13 removed to reveal inserted barrel end cap 12. Perhaps more importantly, the means of attachment of the hub end connector 34 using its jaws 30, both shown in FIGS. 1 and 2, are revealed. The hub end connector jaws 30 are equipped with hub end connector jaw lips 74 (as seen in FIGS. 1 and later in FIGS. 11 and 12). These jaws 30 and jaw lips 72 are sized to be able to pass over barrel end cap flats 44 when aligned therewith and then be rotated under barrel end cap bulges 78 until they reach rotation stops 46. A more complete description of this connection technique is set forth later in regard to FIG. 12. Also seen in FIG. 6 are the eccentric position of the barrel end cap aperture 42, which is necessitated by the overlapping configuration of the inlet tube 18 and the barrel concentric cannula 6 as seen in FIG. 2, the symmetrical positioning of the refill aperture 85, and a screwdriver slot 92 to assemble and. disassemble the tapered barrel 10 and barrel end cap 12.

Figure 7:
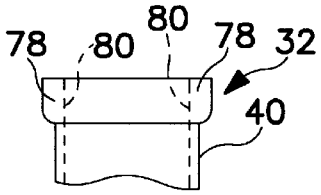
FIG. 7 is a fragmentary plan view of the barrel end showing an enlarged lateral dimension of the barrel end cap bulges of the locking hub end, used to interconnect with the hub end connector jaw lips, which bulges were shown in end view in FIG. 6.

FIG. 7 is a fragmentary plan view of the locking hub end 32 of enlarged barrel top end 40 showing an enlarged lateral dimension of the locking hub end bulges 78, used to interconnect with the hub end connector jaw lips as described in connection with FIG. 6, and which bulges 78 were shown in end view in FIG. 6.

Figure 8:
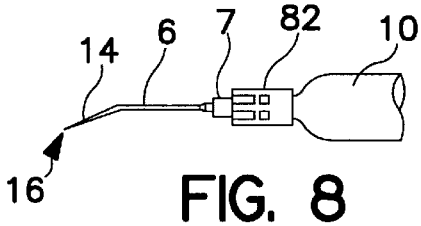
FIG. 8 shows a broken plan view of the discharge end of the barrel with a first alternative embodiment of the cannula in a forty-five degree bent configuration that may be preferred for certain applications or by some users of the invention.

FIG. 8 shows a broken plan view of the discharge end of the tapered barrel 10 with a first alternative embodiment of the cannula 6 in a forty-five degree bent configuration that may be preferred for certain applications or by some users of the invention. Also seen are conventional luer locking male adapter 82, luer locking hub 7, tapered nozzle 14 and discharge orifice 16.

Figure 9:
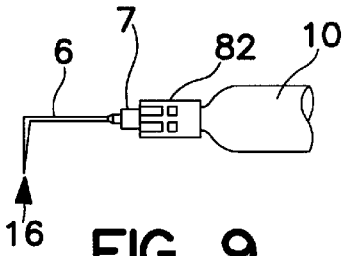
FIG. 9 shows a broken plan view of the discharge end of the barrel with a second alternative embodiment of the cannula in a ninety degree bent configuration that may be preferred for certain other applications or by other users of the invention.

FIG. 9 shows a broken plan view of the discharge end of the tapered barrel 10 with a second alternative embodiment of the cannula in a ninety degree bent configuration that may be preferred for certain other applications or by other users of the invention. Other parts are shown as described in connection with FIG. 8.

Figure 10:
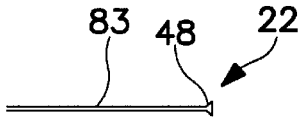
FIG. 10 is a fragmentary plan view of the intake end of an alternative embodiment of the cannula showing that the intake end may be flared.

FIG. 10 is a fragmentary plan view of an alternative embodiment of the intake end 22 of the outlet tube 83. It shows a flared intake end 48.

Figure 11:
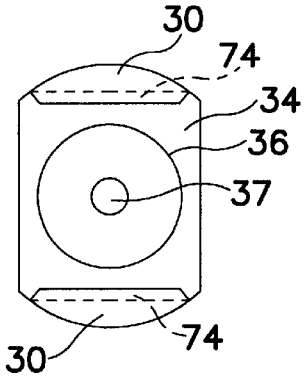
FIG. 11 is an end inside view of the hub end connector showing the hub end connector jaws, body (less its O-ring) and orifice.

FIG. 11 is an end inside view of the hub end connector 34 showing the hub end connector jaws 30, hub end connector body 36 without its O-ring, and hub end connector orifice 37. Also seen are hub end connector jaw lips 74 which pass under and interlock with locking hub end bulges 78 until they reach rotation stops 46 as shown in FIGS. 6 and 7.

Figure 12:
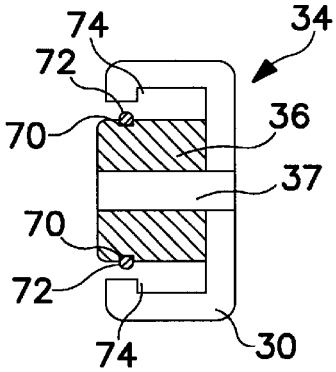
FIG. 12 is a partial cross-sectional view of the hub end connector, showing its O-ring channel, O-ring and hub end connector body in cross-section, and the hub end connector jaws and jaw lips.

FIG. 12 is a partial cross-sectional view of the hub end connector 34, showing its O-ring channel 70, O-ring 72 and hub end connector body 36 in cross-section, and the hub end connector jaws 30 and jaw lips 74. Also seen is hub end connector orifice 37. The features shown and described in this figure taken in combination with features shown and described in FIGS. 11, 6 and 7 can now be combined to demonstrate how the locking hub end 32 of tapered barrel 10 and the hub end connector 34 are assembled and disassembled in practice.

Interconnection of the hub end connector 34 with locking hub end 32 of tapered barrel 10 is achieved by inserting locking hub end 32 into the hub end connector jaws 30 with the locking hub end 32 rotationally oriented so that the hub end connector jaws 30 are adjacent locking hub end flats 44. When the locking hub end 32 has been fully inserted, the locking hub end 32 and hub end connector 34 are rotated with respect to each other until the hub end connector jaws 30 reach the rotation stops 46 such that hub end connector jaw lips 74 pass over and fully engage with locking hub end bulges 78. See FIG. 2. Rotation stops 46 also assure that rotation is done only in the right direction and ceases after there is full engagement in a twist and lock configuration. Sealing is accomplished because the O-ring 72 seen in FIG. 12 comes in contact with the O-ring bearing internal surfaces 80 as seen in FIGS. 6 and 7.

Figure 14:
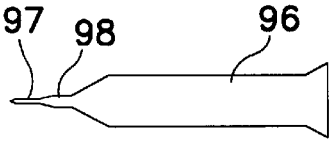
FIG. 14 is a miniature plan view of the filling cartridge.

Of course the above procedure is simply reversed when disassembly is desired. Therefore, when the refillable fluidizing chamber and cannula assembly run out of particulate matter, it takes only a few minutes to disconnect the tapered barrel 10 containing fluidizing chamber 4 at the intersection of locking hub end 32 and hub end connector 34, remove the refill aperture plug 88 in the barrel end 12, and refill the fluidizing chamber 4 of tapered barrel 10 with particulate matter 24 using filling cartridge 96. This is accomplished by employing filling cartridge 96 fill nozzle 98, which is placed in refill aperture 85 of barrel end cap 12. If the filling cartridge 96 has not been used previously, it may be opened using a snap off tip 97 on the fill nozzle 98. See FIGS. 3, 6 and 14. The refill aperture plug 88 is then reinserted into refill aperture 85, threaded in place and tightened using a conventional allen wrench (not shown) that is placed into allen wrench hex recess 89. See FIG. 3. Then, hub end connector 34 and locking hub end 32 can by quickly reconnected as above described.

Figure 13:
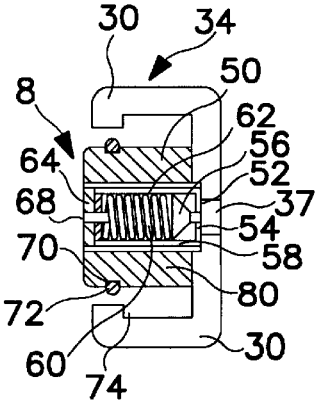
FIG. 13 is a partial cross-sectional view of the hub end connector with the hub end connector body replaced by an alternative embodiment of the check valve in the form of a double acting mechanical check valve and showing the internal structure thereof.

FIG. 13 is a partial cross-sectional view of the hub end connector with the hub end connector body replaced by an alternative embodiment for the dual check valve functions described above. It is in the form of a double acting mechanical check valve 8. Double acting mechanical check valve 8 is comprised of a check valve housing 50, check valve intake manifold 52, check valve intake port 54, resilient valve shuttle 56, check valve cylinder 58, check valve biasing means 60, floating biasing means retainer 62, check valve housing cap 64, check valve discharge port 68, O-ring channel 70, and O-ring 72. All of this cooperates with hub end connector jaws 30 and hub end connector jaw lips 74. Resilient valve shuttle 56 may be made from rubber, and check valve biasing means 60 is preferably a coil spring.

In operation, air pressure entering check valve 8 passes through pneumatic pressure line connector 38 into check valve intake manifold 52. The pressure is exerted on resilient valve shuttle 56 which then overcomes the resistance of the check valve biasing means 60 and opens the check valve intake port 54. The fluid then passes through the check valve cylinder 58 to emerge through the check valve discharge port 68.

When the pressure in the pneumatic pressure line connector 38 drops check valve biasing means 60 causes the resilient valve shuttle 56 to close off the check valve intake port 54 thereby preventing particulate matter from backing up into the pneumatic pressure line connector 38. Similarly in the event of an excessive pressure surge, check valve biasing means 60 will be further compressed and the top surface of resilient valve shuttle 56 will be pressed against check valve discharge port 68 thereby preventing the pressure surge from reaching fluidizing chamber 4.

While the above embodiments describe using particulate matter such as aluminum oxide in the chamber, other particles such as but not limited to sodium bicarbonate can be used. Further, the above embodiments can include a separate water line running through the interior chamber from a conventional outside waterline so that water under pressure can be sprayed onto the target while sodium bicarbonate or aluminum oxide is also used in combination.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended and their equivalents.

What is claimed is:

1. A pressurized particulate matter delivery apparatus commercial unit having a fluidizing chamber for mixing fluid and particulate matter comprising:

an inlet tube connected to a pressurized fluid source and having a discharge end disposed within the fluidizing chamber;

a outlet tube having an intake end disposed within the fluidizing chamber;

wherein the inlet tube discharge end and outlet tube intake end overlap each other;

a detachable cannula in fluid communication with the outlet tube and having a discharge orifice disposed outside the fluidizing chamber;

a particulate matter refill aperture and removable plug to facilitate recharging the fluidizing chamber with particulate matter; and a double function check valve removably disposed between the pressurized fluid source and the fluidizing chamber to prevent backflow of particulate matter in the event of a drop in pressure from the pressurized fluid source and also to prevent a pressure surge from reaching the fluidizing chamber, the check valve further comprising a housing;

an intake manifold disposed within the housing;

an intake port in fluid communication with the intake manifold;

a check valve cylinder disposed within the housing and in fluid communication with the intake port;

a discharge port;

a resilient valve shuttle movably disposed within the check valve cylinder, in fluid communication with the intake port and having both the capability to selectively close off the intake port and, alternatively to selectively close off the discharge port; and a biasing means in physical communication with the resilient valve shuttle to both urge the resilient valve shuttle to close off the intake port in the absence of a predetermined pressure level pressing against resilient valve shuttle and, alternatively to yield to a pressure surge so that the resilient valve shuttle can close off the discharge port.

2. The apparatus of claim 1 in which the particulate matter includes sodium bicarbonate.

3. The apparatus of claim 1 in which particulate matter disposed within the fluidizing chamber may be exhausted in use, and in which the fluidizing chamber may be recharged by a user.

4. The apparatus of claim 1 in which the cannula includes a tapered cannula.

5. The apparatus of claim 1 in which the cannula is bent.

6. The apparatus of claim 1 in which the particulate matter includes aluminum oxide.

7. A pressurized particulate matter delivery apparatus commercial unit having a fluidizing chamber for mixing fluid and particulate matter comprising:

the fluidizing chamber having a tapered barrel and a barrel end cap, and the tapered barrel having internal threads which rotate about and engage mateable threads on the barrel end cap;

an inlet tube connected to a pressurized fluid source and having a discharge end disposed within the fluidizing chamber;

a outlet tube having an intake end disposed within the fluidizing chamber;

wherein the inlet tube discharge end and outlet tube intake end overlap each other;

a detachable cannula in fluid communication with the outlet tube and having a discharge orifice disposed outside the fluidizing chamber;

the inlet tube being fixedly attached to the barrel end cap and the cannula being removably attached to the tapered barrel;

a locking hub end at a top end of the tapered barrel;

locking hub end flats, locking hub end bulges, and rotational stops alternately disposed about a periphery of the locking hub end;

a hub end connector attached to a pressure source;

hub end connector jaws sized to pass over the locking hub end flats and to rotationally engage the locking hub end bulges; and a particulate matter refill aperture and removable plug to facilitate recharging the fluidizing chamber with particulate matter.

8. The apparatus of claim 7 which further comprises:

hub end connector jaw lips disposed on distal ends of the hub end connector jaws; and a hub end connector body disposed between the hub end connector jaws and containing a hub end connector orifice in fluid communication with the pressure source.

9. The apparatus of claim 8 which further comprises:

an O-ring groove disposed in and surrounding the hub end connector body inside the hub end connector jaws;

an O-ring disposed in the O-ring groove:

O-ring bearing internal surfaces disposed on interior surfaces of the locking hub end of the tapered barrel;

such that the locking hub end of the tapered barrel can be inserted in between the hub end connector jaws adjacent the locking hub end flats, and rotated with respect to the hub end connector up to the rotation stops resulting in full engagement of the hub end connector jaw lips with barrel end cap bulges such that the O-ring presses against the O-ring bearing internal surfaces to seal the tapered barrel locking hub end and hub end connector together.

* * * * *